US005938389A

United States Patent [19]

Shore et al.

[11] Patent Number: 5,938,389

[45] Date of Patent: Aug. 17, 1999

[54] METAL CAN AND METHOD OF MAKING

[75] Inventors: Zeev W. Shore, Hazel Crest, Ill.; Sudesh Kumar Nayar, Wiltshire; Nasr Habib Hanna, Oxfordshire, both of United Kingdom

[73] Assignee: Crown Cork & Seal Technologies Corporation, Alsip, Ill.

[21] Appl. No.: 08/900,564

[22] Filed: Jul. 25, 1997

Related U.S. Application Data

[60] Provisional application No. 60/023,039, Aug. 2, 1996.

[51] Int. Cl.[6] ..... B21D 51/26

[52] U.S. Cl. ..... 413/2; 220/673; 413/69; 413/76

[58] Field of Search ..... 413/2, 76, 69, 413/71, 55, 32; 220/673, 672, 671, 670, 669

[56] References Cited

U.S. PATENT DOCUMENTS

| | | | |
|---|---|---|---|
| D. 356,501 | 3/1995 | Kornick et al. | D9/518 |
| 840,091 | 1/1907 | Schumacher et al. | 72/58 |

(List continued on next page.)

FOREIGN PATENT DOCUMENTS

| | | | |
|---|---|---|---|
| 521 637 B1 | 1/1993 | European Pat. Off. . | |
| 543 695 A1 | 5/1993 | European Pat. Off. . | |
| 2667521 | 4/1992 | France | 413/76 |
| 830773 | 2/1952 | Germany . | |
| 1 031 257 | 9/1953 | Germany . | |
| 1 925 014 | 11/1970 | Germany . | |
| 2 131 811 | 12/1972 | Germany . | |
| P23 08 420 | 2/1973 | Germany . | |
| 3 337 382 A1 | 4/1985 | Germany . | |
| 3 716 176 | 9/1988 | Germany . | |
| 94 11 461 | 9/1994 | Germany . | |
| 57-44426 | 3/1982 | Japan . | |
| 613946 | 12/1983 | Japan . | |
| 613946-1 | 11/1985 | Japan . | |
| 61-255725 | 11/1986 | Japan . | |
| 62-199232 | 9/1987 | Japan . | |
| 724416 | 2/1988 | Japan . | |
| 63-052721 | 3/1988 | Japan . | |
| 727797 | 3/1988 | Japan . | |
| 724416-1 | 11/1988 | Japan . | |
| 748958 | 11/1988 | Japan . | |
| 64-2733 | 1/1989 | Japan . | |
| 907967 | 10/1994 | Japan . | |
| 07124656 | 5/1995 | Japan . | |
| 7-165224 | 6/1995 | Japan . | |
| 932536 | 8/1995 | Japan . | |
| 971981 | 1/1997 | Japan . | |
| 388 887 | 3/1965 | Switzerland . | |
| 1570820 | 6/1990 | U.S.S.R. . | |
| 1755992A1 | 8/1992 | U.S.S.R. . | |

(List continued on next page.)

OTHER PUBLICATIONS

Frederic Swing Crispen, C.E. "Dictionary of Technical Terms" Bruce Publishing p. 16 (1946).

*Primary Examiner*—James F. Coan
*Attorney, Agent, or Firm*—Woodcock Washburn Kurtz Mackiewicz & Norris LLP

[57] ABSTRACT

A method of making a non-cylindrical shaped metal can that is provided with a stylized, irregular shape includes steps of forming a substantially cylindrical sidewall portion (12) that has a plurality of ribs integrated therein. These ribs provide additional strength to the sidewall portion. The cylindrical sidewall portion may then be shaped into a non-cylindrical, stylized shape. The ribs (26) are preferably positioned at portions of the shaped sidewall portion (12) that are anticipated to need increased strength in order to withstand deformation under pressure. The sidewall (12) is then assembled to at least one can end member (30) to form a completed shaped metal can (28). The ribs may either be arranged longitudinally, circumferentially, or both may be provided to form a grid structure.

19 Claims, 4 Drawing Sheets

U.S. PATENT DOCUMENTS

| | | | |
|---|---|---|---|
| 2,083,943 | 6/1937 | Clifford | 113/116 |
| 2,748,464 | 6/1956 | Kaul | 29/535 |
| 2,980,993 | 4/1961 | Lyon | 72/370 X |
| 3,029,667 | 4/1962 | Sporck | 80/5 |
| 3,040,684 | 6/1962 | Hillgren | 113/44 |
| 3,224,239 | 12/1965 | Hansson | 72/62 |
| 3,335,590 | 8/1967 | Early | 72/58 |
| 3,461,699 | 8/1969 | Roth | 72/56 |
| 3,610,018 | 10/1971 | Swanson et al. | 72/348 |
| 3,757,555 | 9/1973 | Blutt et al. | 72/63 |
| 3,759,203 | 9/1973 | Frankenberg | 413/69 X |
| 3,831,416 | 8/1974 | Wolfe | 72/117 |
| 3,896,648 | 7/1975 | Schertenleib | 72/61 |
| 3,911,707 | 10/1975 | Minakov et al. | 72/76 |
| 4,055,064 | 10/1977 | Schow | 72/118 |
| 4,289,007 | 9/1981 | Kraft | 72/58 |
| 4,414,834 | 11/1983 | Gratzer et al. | 72/58 |
| 4,827,747 | 5/1989 | Okada et al. | 72/59 |
| 4,947,667 | 8/1990 | Gunkel et al. | 72/56 |
| 5,040,682 | 8/1991 | Palisin, Jr. et al. | 413/69 X |
| 5,058,408 | 10/1991 | Leftault, Jr. et al. | 72/56 |
| 5,187,962 | 2/1993 | Bilko et al. | 72/62 |
| 5,214,958 | 6/1993 | Sanders et al. | 72/58 |
| 5,261,261 | 11/1993 | Ramsey | 72/105 |
| 5,261,558 | 11/1993 | Claydon | 220/671 |
| 5,326,250 | 7/1994 | Doudement | 425/541 |
| 5,334,007 | 8/1994 | Denis et al. | 425/526 |
| 5,338,181 | 8/1994 | Denis et al. | 425/526 |
| 5,342,558 | 8/1994 | Denis et al. | 264/25 |
| 5,622,070 | 4/1997 | Bulso, Jr. | 72/68 |

FOREIGN PATENT DOCUMENTS

| | | |
|---|---|---|
| 216 704 | 6/1924 | United Kingdom . |
| 1 279 421 | 6/1972 | United Kingdom . |
| 1 309 695 | 3/1973 | United Kingdom . |
| 2 003 416 | 3/1979 | United Kingdom . |
| 2 123 329 | 2/1984 | United Kingdom . |
| 2 120 148 | 7/1985 | United Kingdom . |
| 2 224 965 | 5/1990 | United Kingdom . |
| 2 257 073 | 1/1993 | United Kingdom . |
| 2 266 290 | 10/1993 | United Kingdom . |
| WO 83/01916 | 6/1983 | WIPO . |
| WO 92/13653 | 8/1992 | WIPO . |
| WO 94/10481 | 5/1994 | WIPO . |
| WO 95/08410 | 3/1995 | WIPO . |
| WO 95/15227 | 6/1995 | WIPO . |
| WO 97/12704 | 4/1997 | WIPO . |
| WO 97/12705 | 4/1997 | WIPO . |
| WO 97/12706 | 4/1997 | WIPO . |

METAL CAN AND METHOD OF MAKING

This application claims §119(e) priority based on provisional application 60/023,039, filed on Aug. 2, 1996.

BACKGROUND OF THE INVENTION

1. Field of the Invention

This invention relates to metal cans, such as those which are in wide use for packaging soft drinks and other beverages. More specifically, this invention relates to an improved metal can, and especially a stylized, shaped can, that provides enhanced strength characteristics at a given container weight as compared with conventional metal containers.

2. Description of the Related Technology

Today's market for metal beverage cans is extremely price competitive, which necessitates making the cans from the least amount of metal possible while still providing the necessary structural integrity to prevent collapsing or wrinkling the container's side wall. Considering the enormous volume of cans that are made worldwide each year, even a small reduction of the amount of material that is necessary to provide a can of adequate strength promises substantial cost savings to the industry. Accordingly, a great deal of effort is being put into the development of metal cans having improved strength to weight characteristics.

It has been proposed to manufacture two-piece can bodies with circumferential, longitudinal or helical reinforcing ribs in order to impart additional column or crush strength to the can body wall. In particular, German published patent application DE 23 08 420 (1974) discloses formation of a can body with either helical and longitudinal ribs by means of a standard drawing and ironing technique wherein the punch is configured to create the additional thickness of the reinforcing ribs. A similar invention was the subject of published PCT application WO83/01916. U.S. Pat. No. 3,610,018 to Swanson et al. discloses manufacturing circumferential reinforcement ribs into a steel can body in order to increase the buckling resistance of a steel can.

Recently, there has been a great deal of interest in the can making industry about the possibility of manufacturing so-called "shaped" cans, which are configured to deviate from the standard "straight" or cylindrical shape. A shaped can might be attractive to a customer, for example, because it can suggest a beverage manufacturer's distinctive glass or plastic bottle designs, or other aesthetic or trade dress features. A shaped can is typically made from a cylindrical metallic preform, which is shaped and sized quite similarly to a standard straight or cylindrical can body. The metallic preform is forced into the desired shape by one of a number of different known methods, most of which use mechanical or gaseous pressure, or some combination thereof. A complete understanding of the deformation techniques for making shaped cans, which are still evolving, is not critical to an understanding of this invention.

Unfortunately, the shaping process tends to place a great deal of strain on certain localized areas of the can preform. Furthermore, any deviation from a cylindrical shape can reduce, among other things, the axial strength of the can. In addition, shaped cans tend to be more susceptible than straight cans to outward bowing or other deformation such as when they are internally pressurized by carbonation. The extent, location and type of deformation will depend on the specific configuration of shaped can. For example, one shaped can design with which the inventors are familiar has a portion that includes broad, inwardly extending generally longitudinal depressions or grooves which tend to be pushed outwardly under pressure. The conventional thought would be that this could and must be rectified by increasing the can's wall thickness. Doing that, however, would add to the customer's projected packaging expenses, making the can design less attractive to the final customer, who is usually the soft drink manufacturer or bottler.

A need exists in the industry for an improved metal can body and method of making that provides additional strength and deformation resistance to a can body, and especially to a shaped can body, without adding substantial weight to the can body.

SUMMARY OF THE INVENTION

Accordingly, it is an object of the invention to provide an improved metal can body and method of making that provides additional strength and deformation resistance to the can body, without adding substantial weight to the can body.

In order to achieve the above and other objects of the invention, a method of making a metal can, includes, according to one aspect of the invention steps of (a) forming a sidewall portion that has a plurality of circumferentially extending ribs integrated therein, the ribs providing additional hoop strength to the sidewall portion, and a plurality of substantially longitudinally extending ribs, the longitudinal and circumferential ribs thereby forming a gridwork of reinforcing cells in the sidewall portion; and (b) assembling at least one can end member to the sidewall portion to complete formation of a metal can.

According to another aspect of the invention, a method of making a non-cylindrical shaped metal can body that is provided with a stylized, irregular shape, includes steps of (a) forming a substantially cylindrical sidewall portion that at least one circumferentially extending rib integrated therein, the rib providing additional strength to the sidewall portion; and (b) shaping the cylindrical sidewall portion into a non-cylindrical, stylized shape, and wherein the ribs are positioned at portions of the shaped sidewall portion that are anticipated to need increased hoop strength in order to withstand deformation under pressure, whereby the shaped sidewall portion is reinforced against deformation without increasing overall thickness of the sidewall.

According to yet another aspect of the invention, a metal can includes a sidewall portion that has a plurality of circumferentially extending ribs and a plurality of substantially longitudinally extending ribs in the sidewall, the longitudinal and circumferential ribs forming a gridwork of reinforcing cells in the sidewall portion that will enhance the strength of the sidewall portion; and at least one can end member sealed to the sidewall portion, whereby the can has superior strength characteristics when compared to a can of like weight that does not possess such circumferentially extending ribs.

In a further aspect of the invention, a metal can body includes a sidewall portion that has at least one circumferentially extending rib integrated therein, the rib providing additional hoop strength to the sidewall portion, and wherein the sidewall portion is configured in a non-cylindrical, stylized shape, and wherein the rib is positioned at a portion of the shaped sidewall portion that is anticipated to need increased hoop strength to withstand deformation under pressure.

It has also been found that producing cans that have longitudinal ribs extending inwardly from the inner surface of the can provides additional strength and as a consequence permits the amount of metal in the sidewall to be further reduced.

Finally another aspect of the invention comprises a metal can includes a sidewall portion that has at least one circumferentially extending rib integrated therein, the rib providing additional hoop strength to the sidewall portion, and wherein the sidewall portion is configured in a non-cylindrical, stylized shape, and wherein the rib is positioned at a portion of the shaped sidewall portion that is anticipated to need increased hoop strength to withstand deformation under pressure; and at least one can end member sealed to the shaped sidewall portion, whereby a metal can is formed that is less likely to deform under the pressure of carbonation than a can without such reinforcing ribs.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENTS

Figure 1:
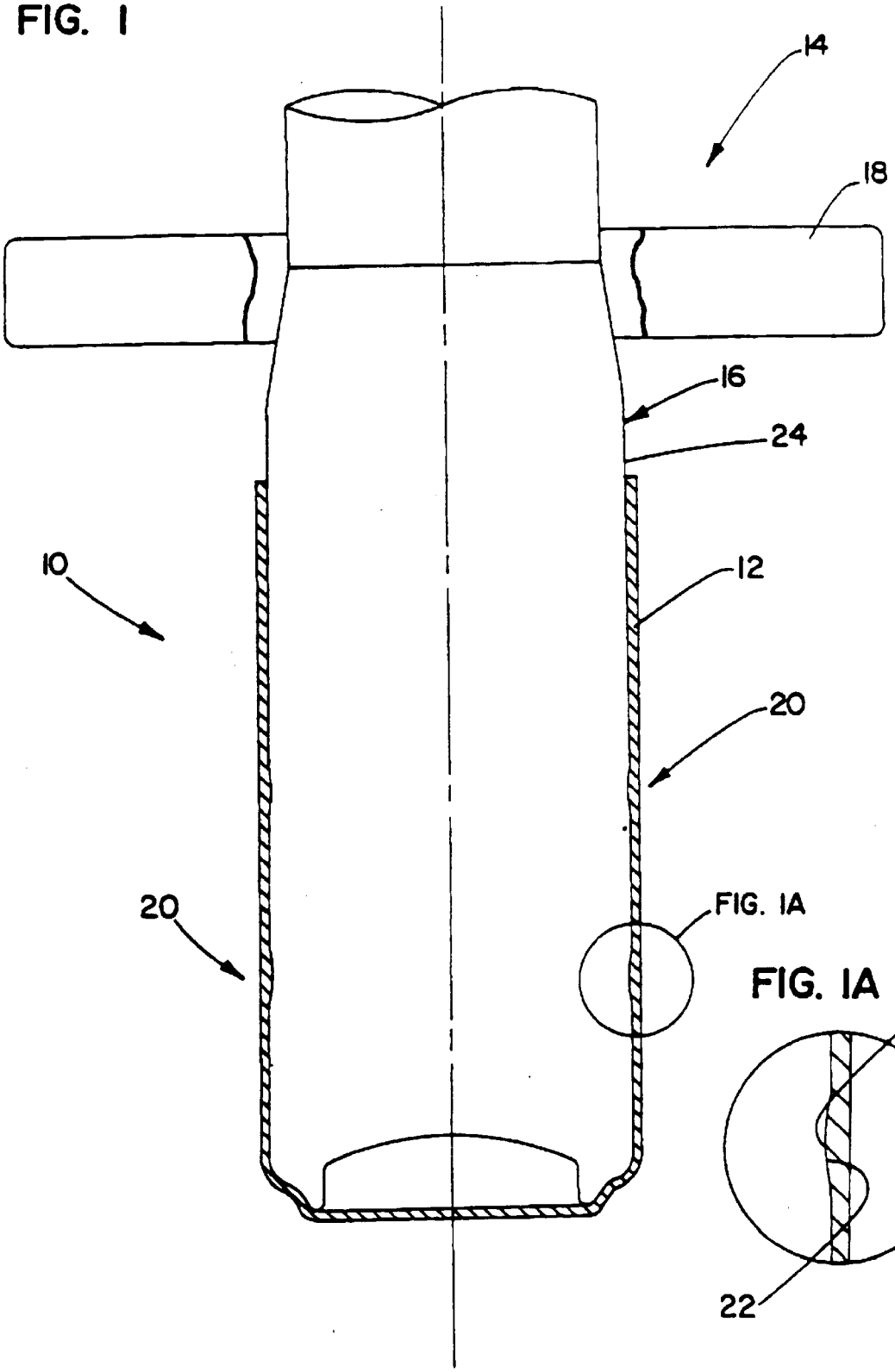
FIGS. 1 and 1A are a diagrammatical view of a method of manufacturing a side wall for a can body or a shaped can preform according to a first embodiment of the invention.
Figure 1A:
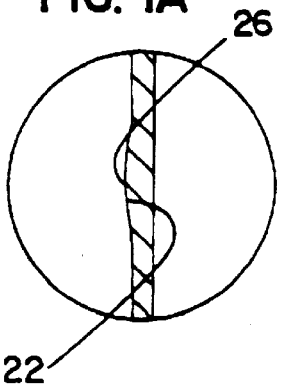

Referring now to the drawings, wherein like reference numerals designate corresponding structure throughout the views, and referring first to FIGS. 1 and 1A, a can body or preform 10 for a shaped can is depicted having a sidewall 12 along with a standard assembly 14 for drawing and ironing a can body, the details of which are well known in this area of technology. Assembly 14 includes a punch body 16 and one or more rings 18, as, again, is well known in the industry. Can body or preform 10 is preferably, although not necessarily, fabricated from aluminum.

Figure 2:
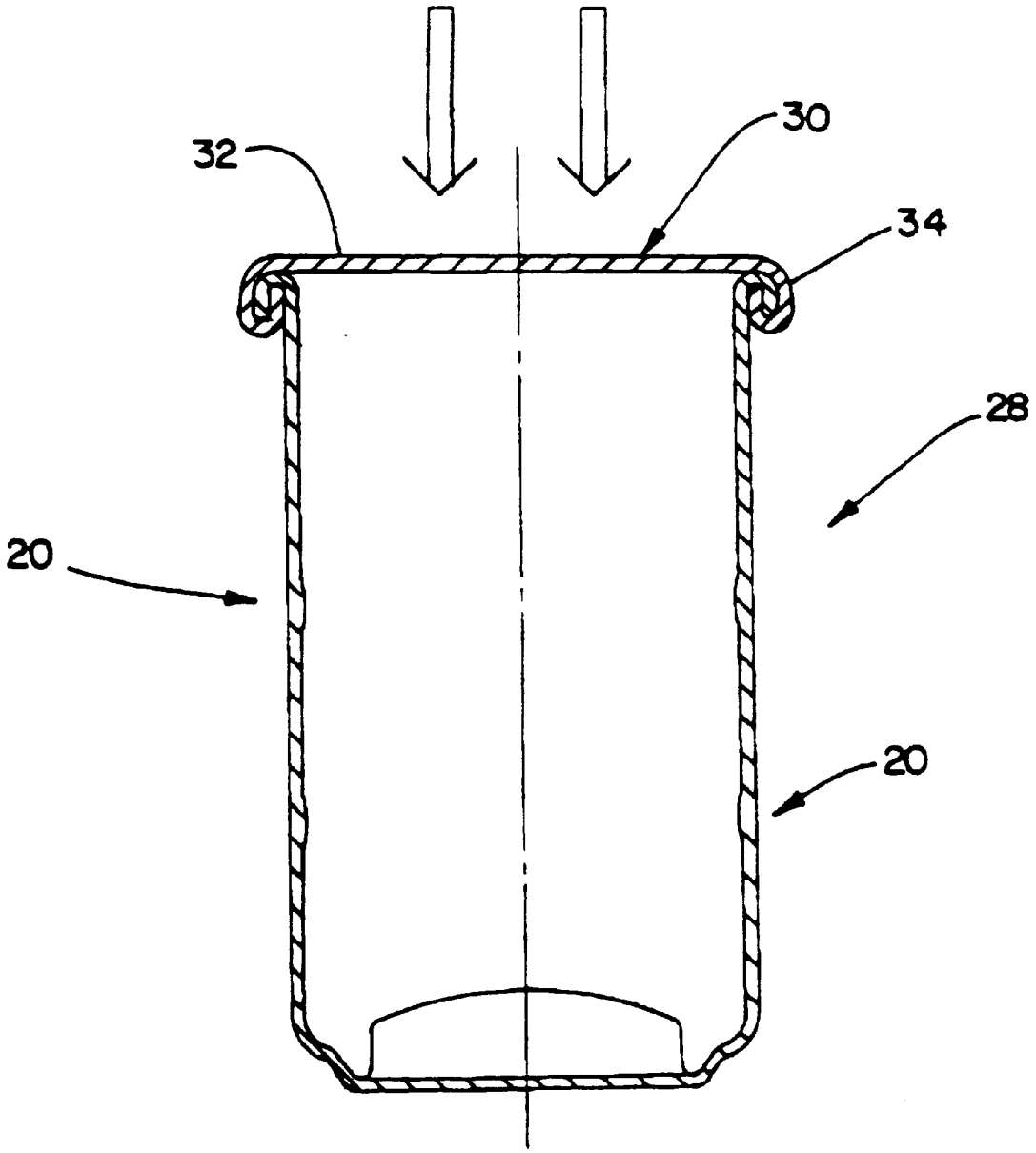
FIG. 2 is a cross sectional view taken through a reinforced can that is made according to the process depicted in FIG. 1.

According to a preferred embodiment of the invention that is depicted in FIGS. 1, 1A and 2, the can body preform is manufactured with at least one reinforced area 20, which is in the illustrated embodiment a pair of circumferentially extending ribs in the sidewall 12 of the can body or preform. As may be seen in FIG. 1, the outer surface 24 of punch body 16 includes a pair of circumferentially extending grooves 22 which allow formation of the correspondingly shaped ribs 26 during the drawing and ironing process. Ribs 26 impart additional strength to the sidewall of can body/preform 12, which improves the vertical crush strength, the lateral crush strength, and the strength against expansion due to internal pressurization.

Looking to FIG. 2, a reinforced can 28 may be manufactured from the sidewall of the can body/preform 12 by fastening a can end member 30 having an end panel 32 to the can body through a traditional double seam type joint. The process for joining the can end member 30 to the can body is well known in the industry.

Figure 3:
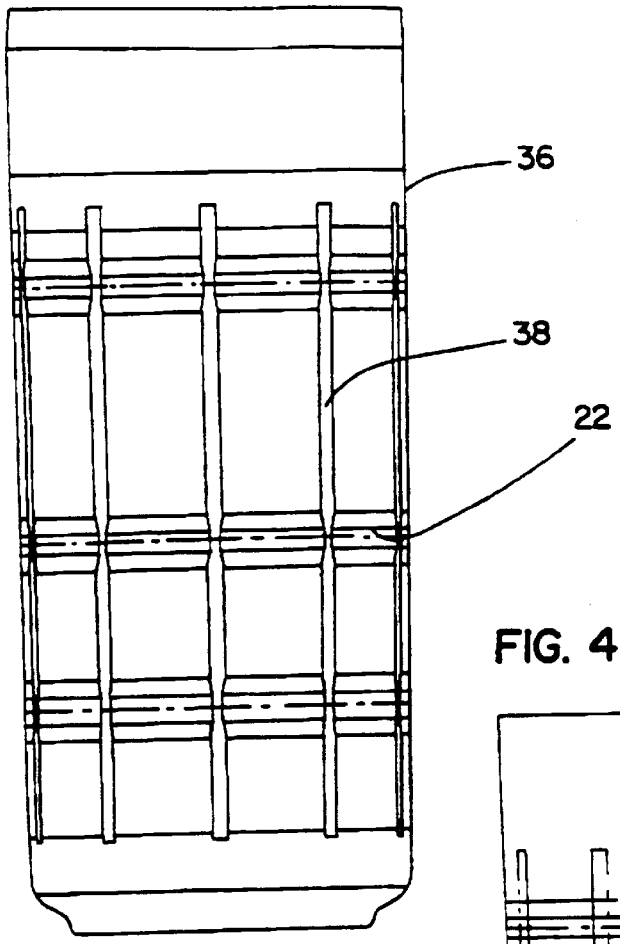
FIG. 3 is a side elevational view of a drawing and ironing punch that is made for use in a process according to a second embodiment of the invention.
Figure 4:
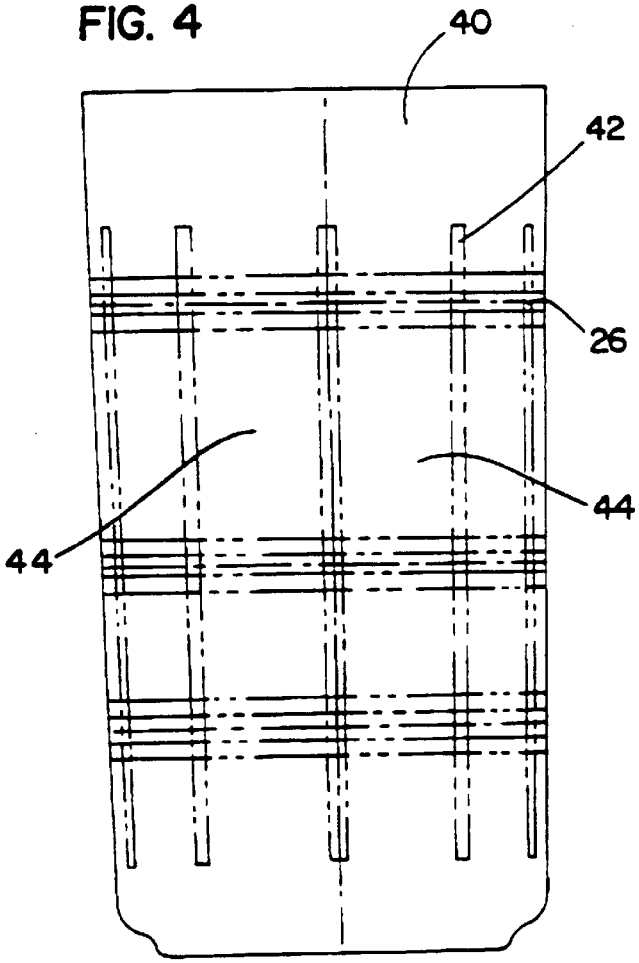
FIG. 4 depicts a can body or preform that is made according to the process using the drawing and ironing punch shown in FIG. 3.

Referring now to FIGS. 3 and 4, the punch and the drawing and ironing assembly 14 that is shown in FIG. 1 may alternatively be embodied as a punch 36, shown in FIG. 3, that has, in addition to the circumferentially grooves 22, of which there are three in the embodiment of FIG. 3, a plurality of longitudinal grooves 38. A can body/preform 40 that is manufactured by use of the punch 36 is illustrated in FIG. 4. As may be seen in FIG. 4, can body/preform 40 includes a corresponding number of circumferentially reinforcing ribs 26, and longitudinal reinforcing ribs 42. Longitudinal ribs 42 will enhance the vertical crush resistance of the container, which is needed for, among other design reasons, to resist deformation from axial compressive stresses that are applied during the double-seaming operation. Ribs 42, 26 interact to form a plurality of reinforcing cells 44, the combined effect of which substantially strengthen the rigidity of the sidewall of the can body/preform 40 to an extent that the strength to weight ratio of the can body/preform 40 exceeds that which was possible with a similarly shaped and weighted cylindrical can body configuration. This construction of the sidewall having the reinforcing cells 44, in addition to increasing the strength to weight ratio, also increases the puncture resistance of the can wall body, thereby permitting additional lightweighting that would otherwise not be possible for fear of susceptibility to puncturing.

A shaped metal can body 46 is depicted which will be recognized as a design that is proprietary to a major soft drink manufacturer. This particular shaped can design includes a number of inwardly extending longitudinal oriented grooves 62, which, absent reinforcement, tend to bow outwardly under pressure, thus making the design substantially unworkable unless the wall thickness of the can body is increased to an extent that would make the can body economically unattractive to the potential customer. However, by use of the invention, this area is adequately reinforced without substantially increasing the weight of the can body. This is achieved by strategically placing reinforced areas 48, 50, 52 at portions of the shaped sidewall that are anticipated to need increased hoop strength in order not to deform under pressure. Reinforced areas 48, 50, 52 are, in fact, the areas which correspond to the circumferential ribs 26 that are formed according to either the embodiment of the invention that is depicted in FIG. 1 or that which is depicted in FIG. 4. Rib 26 translate, after expansion of the can body into the shaped metal can body 46, into ribs 54, 56, 58, respectively. The longitudinal reinforcing ribs 42 that are illustrated in the embodiment 40 may also be used to reinforce the shaped metal 46, and appear as longitudinal ribs 62 that are shaped and placed strategically at areas of potential weakness of the can body 46. The circumferential ribs 54, 56, 58 and the longitudinal ribs 60 together define a number of reinforcement cells 64, which, as in the case of the preform/can body 40 in the embodiment of FIG. 4, substantially increase the strength of the shaped metal can body 46. After formation, the shaped metal can body 46 may be assembly into a reinforce can in a method that identical to that depicted in FIG. 2.

It has also been found that certain straight wall and shaped can designs can be improved by the addition of longitudinal ribs 62 alone. Most preferably, the ribs 62 are arranged to extend inwardly from the inner surface of the can body 46 so that the exterior surface appears smooth and can be subsequently shaped. It will be realized, however, that certain aesthetic benefits might be realized by placing the ribs on the exterior surface and thus such embodiments are within the scope of this invention.

It has been found that the use of longitudinal ribs alone increases the strength of the can, particularly in terms of the ability to resist axial loads. These benefits are realized whether the can has a straight cylindrical wall, or is contoured.

Because the ribs described above add strength, it is now possible to reduce the amount of metal in the sidewall. The inwardly protruding ribs will preferably rise above thin areas of the sidewall that are substantially wider than the ribs themselves.

An important feature, however, is again that the ribs may be selectively placed to enhance the strength of the can in the areas of greatest stress.

Figure 5:
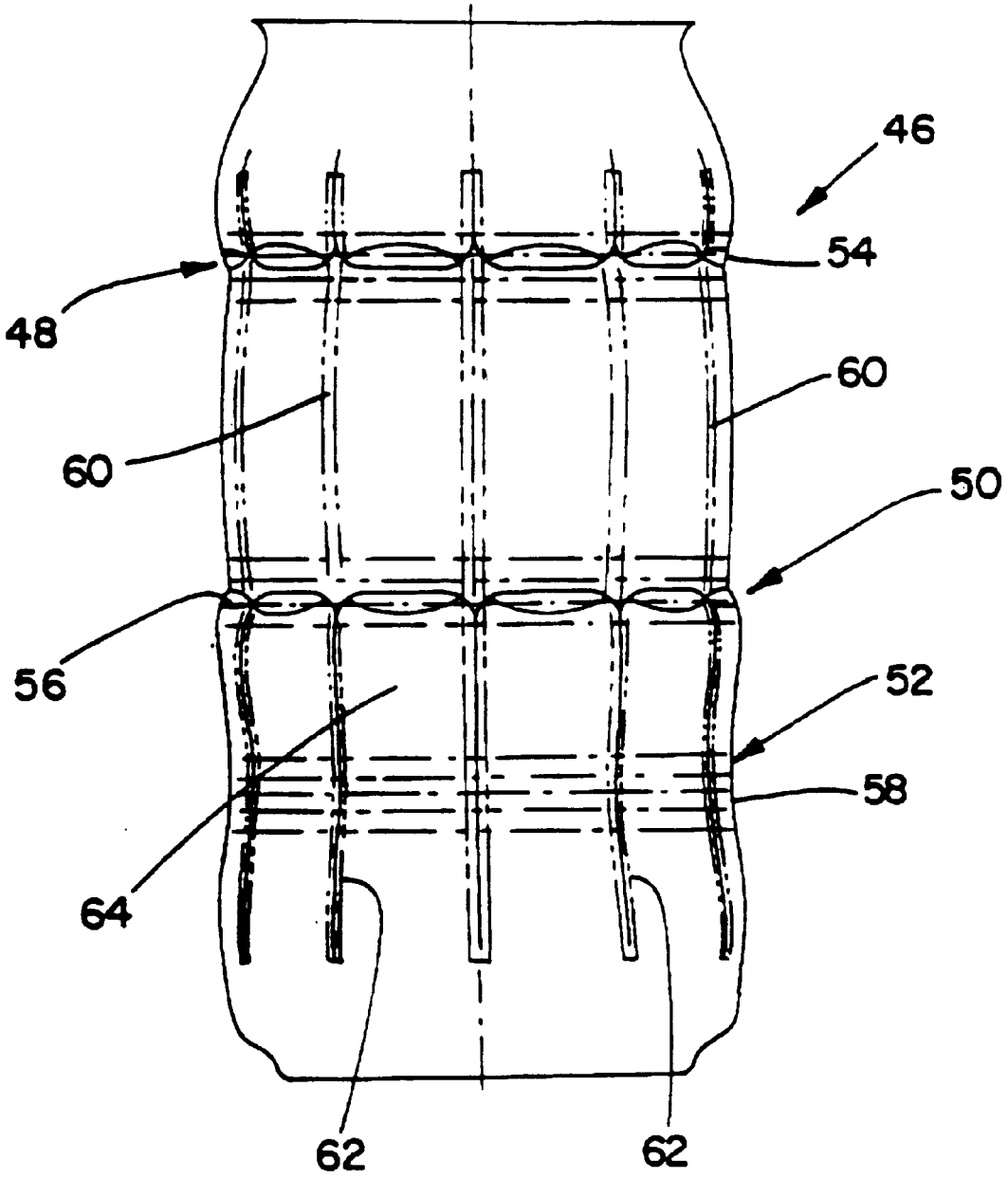
FIG. 5 depicts a shaped metal can body that is made according to a preferred embodiment of the invention.

The thickness of the reinforcing ribs that are necessary to achieve the benefits described hereinabove will depend on the specific shape and application of the can body itself, as well as the can's wall thickness. As an example, however, for a can having the shape shown in FIG. 5, it is preferable to have a baseline wall thickness of about 0.0041 inches, and for the vertical and circumferential reinforcing ribs to add about another 0.001 to 0.002 inches of wall thickness at the locations that are intended to be reinforced. This results in a total sidewall thickness of about 0.005 to 0.006 inches at the location of the reinforcing ribs.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of making a non-cylindrical shaped metal can body that is provided with a stylized shape, comprising:

(a) forming a substantially cylindrical sidewall portion having at least one circumferentially extending rib integrated therein, said rib providing additional strength to the sidewall portion; and (b) thereafter expanding the cylindrical sidewall portion into a non-cylindrical, stylized shape, and wherein said ribs are positioned at portions of said expanded sidewall portion that are anticipated to need increased strength, whereby said expanded sidewall portion is reinforced without increasing overall thickness of the sidewall.

2. A method according to claim 1, further comprising a step of:

assembling at least one can end member to said shaped sidewall portion, thereby forming a completed shaped metal can.

3. A method according to claim 1, wherein step (a) comprises a drawing and ironing process that is performed with a punch that has at least one circumferential groove therein corresponding to said circumferentially extending rib(s).

4. A method according to claim 1, wherein step (a) further comprises forming at least one rib in said sidewall portion that is not fully circumferential.

5. A method according to claim 1, wherein step (a) further comprises forming a plurality of substantially longitudinally extending ribs integrally into the sidewall, said longitudinal and circumferential ribs thereby forming a gridwork of reinforcing cells in the sidewall portion that will enhance column strength, hoop strength, crush strength and pressure strength.

6. A method according to claim 1, wherein there are a plurality of said circumferential ribs.

7. A method according to claim 1, wherein said circumferentially extending rib is formed by an area of increased thickness in said sidewall.

8. The method of claim 1 wherein the step of expanding comprises creating a positive pressure differential between the interior of the can body and an external environment.

9. A can made according to the method described in claim 1.

10. A method according to claim 7, wherein said thickened circumferentially extending rib projects radially inwardly from said sidewall portion.

11. A metal can body, comprising:

a sidewall portion that has at least one circumferentially extending rib and a plurality of substantially longitudinally extending ribs integrated therein, said circumferentially extending rib providing additional strength to the sidewall portion, and wherein said sidewall portion is configured in a non-cylindrical, stylized shape, and wherein said circumferential extending rib and said longitudinally extending ribs are positioned at locations of said shaped sidewall portion that are anticipated to need increased strength, wherein said longitudinal and circumferential ribs form a gridwork of reinforcing cells in the sidewall portion that enhance column strength, hoop strength, crush strength and pressure strength.

12. A metal can body according to claim 11, wherein said circumferentially extending rib and said plurality of longitudinally extending ribs are each formed by an area of increased thickness in said sidewall.

13. A metal can body according to claim 12, wherein said circumferentially extending rib and said plurality of longitudinally extending ribs each project radially inwardly from said sidewall portion.

14. A metal can body according to claim 12, wherein said non-cylindrical stylized shape of said sidewall portion comprises a plurality of longitudinally extending grooves formed in said sidewall portion, and wherein each of said thickened longitudinally extending ribs are located in one of said grooves.

15. A method of making a metal can, comprising:

(a) forming a sidewall portion that has a plurality of substantially longitudinally extending ribs, said longitudinal ribs providing additional axial strength;

(b) assembling at least one can end member to said sidewall portion to complete formation of a metal can; and (c) forming the sidewall portion into a non-cylindrical, shaped can at a point in time after step (a).

16. A can made according to the method described in claim 15.

17. A method according to claim 15, wherein step (a) comprises a drawing and ironing process that is performed with a punch that has a plurality of longitudinal grooves therein corresponding to said ribs.

18. A method according to claim 15, wherein each of said longitudinally extending ribs are formed by an area of increased thickness in said sidewall.

19. A method according to claim 18, wherein each of said thickened longitudinally extending ribs projects radially inwardly from said sidewall portion.

* * * * *

UNITED STATES PATENT AND TRADEMARK OFFICE

CERTIFICATE OF CORRECTION

PATENT NO. : 5,938,389 
DATED : August 17, 1999
INVENTOR(S) : Shore et al.

It is certified that error appears in the above-indentified patent and that said Letters Patent is hereby corrected as shown below:

Cover Page, Column 1, line 8 beneath "FOREIGN PATENT DOCUMENTS" delete "P 23 08 420" and insert - - P23 08 420.0- - therefor.

Cover Page, Column 1, line 8 beneath "FOREIGN PATENT DOCUMENTS" delete "94 11 461" and insert - - 94 11 461.7- - therefor.

Page 2, Column 2, Line 4 beneath "FOREIGN PATENT DOCUMENTS" insert --A-- after "2 003 416" .

Page 2, Column 2, Line 5 beneath "FOREIGN PATENT DOCUMENTS" insert --A-- after "2 123 329" .

Page 2, Column 2, Line 6 beneath "FOREIGN PATENT DOCUMENTS" insert --B-- after "2 120 148" .

Page 2, Column 2, Line 7 beneath "FOREIGN PATENT DOCUMENTS" insert --A-- after "2 224 965" .

Page 2, Column 2, Line 8 beneath "FOREIGN PATENT DOCUMENTS" insert --A-- after "2 257 073" .

Page 2, Column 2, Line 9 beneath "FOREIGN PATENT DOCUMENTS" insert --A-- after "2 266 290" .

Column 3, Line 2, delete "includes" and insert --including-- therefor.

Column 4, Line 49, delete "Rib" and insert --Ribs-- therefor.

UNITED STATES PATENT AND TRADEMARK OFFICE

CERTIFICATE OF CORRECTION

PATENT NO. : 5,938,389
DATED : August 17, 1999
INVENTOR(S) : Shore et al.

It is certified that error appears in the above-indentified patent and that said Letters Patent is hereby corrected as shown below:

Column 4, Line 53, delete "metal 46," and insert --metal body 46,-- therefor.

Column 4, Line 61, delete "be assembly into a reinforce can in a method that identical" and insert --be assembled into a reinforced can in a method that is identical-- therefor.

Column 6, Line 8 of Claim 11, delete "circumferential extending rib" and insert --circumferentially extending rib-- therefor.

Signed and Sealed this

Eighth Day of May, 2001

*Attest:*

Nicholas P. Godici

NICHOLAS P. GODICI

*Attesting Officer*

*Acting Director of the United States Patent and Trademark Office*